US007314191B2

(12) United States Patent
Nikam

(10) Patent No.: US 7,314,191 B2
(45) Date of Patent: Jan. 1, 2008

(54) TWO ROLL SUGARCANE CRUSHING MILL

(76) Inventor: Bhausaheb Bapurao Nikam, 101, Poorva Plaza, 515, Sadashiv Peth, Pune 411 030 (IN)

( * ) Notice: Subject to any disclaimer, the term of this patent is extended or adjusted under 35 U.S.C. 154(b) by 23 days.

(21) Appl. No.: 10/476,802

(22) PCT Filed: May 11, 2001

(86) PCT No.: PCT/IN01/00101

§ 371 (c)(1),
(2), (4) Date: Nov. 4, 2003

(87) PCT Pub. No.: WO02/092859

PCT Pub. Date: Nov. 21, 2002

(65) Prior Publication Data

US 2004/0129811 A1 Jul. 8, 2004

(51) Int. Cl.
*B02C 1/08* (2006.01)
*B02C 23/02* (2006.01)

(52) U.S. Cl. ..... 241/222; 241/232; 241/233; 100/166; 100/168

(58) Field of Classification Search ..... 241/222, 241/232, 227, 233, 235, 285.1; 100/121, 100/169, 170, 166, 168
See application file for complete search history.

(56) References Cited

U.S. PATENT DOCUMENTS 1,844,877 A * 2/1932 Wentzel ..... 100/162 R
2,704,023 A * 3/1955 Schwarz ..... 100/166
3,049,074 A * 8/1962 Mellin ..... 100/162 R
4,077,316 A * 3/1978 Georget ..... 100/163 R
4,192,228 A * 3/1980 Antoniuk et al. ..... 100/37
4,357,171 A * 11/1982 Nurse ..... 127/5
5,358,571 A * 10/1994 Villavicencio et al. ..... 127/2
5,855,168 A * 1/1999 Nikam ..... 100/121

FOREIGN PATENT DOCUMENTS

GB 2026898 A * 2/1980
GB 2056878 A * 3/1981
GB 2177322 * 1/1987
GB 2189713 A * 11/1987

* cited by examiner

*Primary Examiner*—Bena Miller
(74) *Attorney, Agent, or Firm*—Egbert Law Offices

(57) ABSTRACT

An improved two roll sugarcane crushing mill has two roll mill modules in tandem, each has a pair of main crushing rolls having a bottom roll and a top roll. The bottom and top rolls are rotatingly mounted in a pair of main frames and a pair of top beams at the two ends respectively. One end of each of the top beams is pivotally attached near an upper end of the main frames towards a feed side for swinging the top beams along with the top roll. At least one feeder roller is provided with a scraper-cum-deflector with a juice drainer in the close proximity of the main crushing rolls. The feeder rollers are mounted on an auxiliary frame which is mounted on the main frame to adjust the loading the feeder roller in a desired position.

10 Claims, 3 Drawing Sheets

TWO ROLL SUGARCANE CRUSHING MILL

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This invention relates to an improved two roll sugarcane-crushing mill. More particularly this invention relates to a two roll sugarcane crushing mill in which multiple feeder rollers are used, without needing a closed stationary pressure chute for compressed/compact feeding of prepared cane/bagasse mat and in which pivoted hydraulic system attached to a lever arm for free floating top roll is provided to give more loading at less hydraulic pressure and at the same time easy dismantling of top and bottom rolls, and reduced hydraulic seal failure resulting into low maintenance cost, less power consumption and same performance, as of existing mill, with less number of mill modules/rolls.

BACKGROUND OF THE INVENTION

In the conventional two roll sugarcane crushing mill a plurality of two roll mill modules are used in tandem. Each of the two roll mill module comprises a bottom roll and top roll mounted in a pair of closed frame/headstock provided at the two ends, for allowing the cane/bagasse feeding between the two rolls, these rolls are kept inclined, instead of vertical, that is the central axis of top and bottom rolls is inclined at about 25 degree from the vertical axis. The top roll is directly loaded to press the same towards the bottom roll. For this top roll bearings slide in the headstock/frame at the two ends of the top roll.

Sometimes, a feeder roller which is generally a grooved roller fixedly mounted on the frame, without any scraper-cum-deflector, is provided to compress/compact the prepared cane/bagasse mat for feeding between the two rolls.

When two or more feeder rollers are used for compressing/compacting the cane/bagasse mat to be into the gap between the two rolls, a stationary closed pressure chute is also required to be provided between the feeder rollers and main crushing rolls.

The main draw backs of the conventional two roll sugarcane crushing mill are as given below:

i) The top and bottom rolls being mounted in the inclined position, top roll bearings slide in the inclined plane resulting in side friction on the bearings and more functional load and more maintenance.

ii) The top roll is directly loaded to press it against the bottom roll for which top roll bearings slide in the head stock at the two ends, and are subjected to uneven wear at top and bottom sides, resulting into sluggish floating of the top roll instead of free floating.

iii) The top roll being directly loaded and central axis of top and bottom rolls being inclined more hydraulic load is required needing more power consumption for a desired load.

iv) Hydraulic cylinder being rigidly mounted in an inclined plane for direct loading of top roll, hydraulic seal failure is considerably more.

v) In case of a single feeder roller provided for compact feeding of cane/bagasse the compressed cane is again expanded, as there is no scraper/deflector provided with the feeder roller, thereby gripping angle of the main crushing rolls is increased resulting into reduced cane crushing capacity of the mill, and higher power consumption due to more number of rolls.

vi) As there is no scraper or any other juice removing means like lotus type construction provided with the feeder roller, juice is not removed by the feeder roller, resulting into lower juice extraction efficiency/capacity of the mill and more power consumption as more number of rolls will be required for the same juice extraction capacity of the mill.

vii) As the top and bottom rolls are mounted in a pair of closed frames and are directly loaded, while dismantling the rolls for maintenance and/or repairing the top cap with hydraulic loading means is also to be removed and then only the top and bottom rolls are lifted upwards, which takes more time and labor, thus besides higher maintenance cost, mill down time is also more, resulting in lower productivity of the crushing mill.

viii) In case of two or more feeder rollers needing a stationary closed pressure chute provided between the feeder rollers and the main crushing rolls, all the inherent drawbacks of the stationary closed pressure chute, which are well known and described in the present inventor's co-pending patent application Indian Patent application No. 32/130M/93, are there, resulting in higher initial cost and maintenance cost, more mill down time, more power requirement and lower productivity of the mill.

OBJECTS OF THE INVENTION

The main object of this invention is to obviate the above mentioned drawbacks of the existing two roll sugarcane crushing mill and to provide an improved two roll sugar cane crushing mill wherein the top and bottom rolls are mounted in a pair of open main frames, keeping the central axis of top and bottom rolls in substantially vertical position, instead of inclined as in conventional mills for giving more effective pressure on the prepared cane/bagasse mat, passing through the gap in between the top and bottom roll and wherein the pressure on the top rolls is applied through a leverage pivoted towards feed side instead of direct loading, as in conventional mills, for using less power and working hydraulic pressure for the same load.

Another object of this invention is to provide an improved two roll sugarcane crushing mill wherein the hydraulic cylinder for loading the top roll is pivotally and flexibly mounted at the end of a lever arm to give free floating of the top roll and reducing the chances of hydraulic seal/system failure considerably, thereby low maintenance and mill down time, giving higher productivity.

A further object of this invention is to provide a two roll sugarcane crushing mill wherein for maintenance and or repair, the top and bottom rolls are removed very easily from the open side of the frame, without completely removing the hydraulic loading system means, thus the time taken and man-power required for maintenance are reduced considerably thereby reducing the maintenance cost and increasing the productivity of the mill.

A further object of this invention is to provide an improved two roll sugarcane crushing mill wherein multiple (two or more) feeder rollers with or without scraper-cum-deflector can be provided without needing a stationary closed pressure chute for achieving an additional compression of the cane/bagasse, increasing juice extraction capacity and productivity of the mill.

A further object of this invention is to provide an improved two roll sugarcane crushing mill wherein a single feeder roller is provided with scraper-cum-deflector, so that cane/bagasse mat once compressed will not expand and thereby gripping angle is much reduced and thus increasing the feedability cane crushing capacity of the mill, with less number of rolls and hence reducing the power required for the mill, considerably.

A further object of this invention is to provide an improved two roll sugarcane crushing mill wherein the bottom crushing roll is of substantially larger diameter than the top roll and the central axis is kept substantially vertical to allow increased free flow of juice by gravity.

A further object of this invention is to provide an improved two roll sugarcane crushing mill wherein the last mill module of the mill tandem may be an existing type three roll mill to exhaust low moisture content bagasse from the final stage of the sugar cane crushing mill.

BRIEF SUMMARY OF THE INVENTION

Accordingly this invention provides an improved two roll sugarcane crushing mill comprising of a plurality of improved two roll mill modules in tandem, each of the said improved two roll mill module comprises a pair of main crushing roll consisting of a bottom roll and a top roll, the said bottom roll being rotatingly mounted in a pair of main frames/head stocks at the two ends, the said top roll being rotatingly mounted in a pair of top beams/lever arms at the two ends one end each of the said top beams being pivotally attached near the upper end of the head stocks towards feed side for swinging the said top beams along with the top roll, a hydraulic loading means pivotally attached between the other end of the said top beam and the base of the main frame, at least one feeder roller, with a scraper-cum-deflector with juice drainage means provided in the close proximity of the said main crushing rolls, the said feeder roller being mounted on an auxiliary frame and the said auxiliary frame being rigidly or pivotally mounted preferably on the said main frame for swingably adjusting the loading and setting the said feeder roller in a desired position.

BRIEF DESCRIPTION OF THE SEVERAL VIEWS OF THE DRAWINGS

The invention will now be described with reference to accompanying drawings.

DETAILED DESCRIPTION OF THE INVENTION

Figure 1:
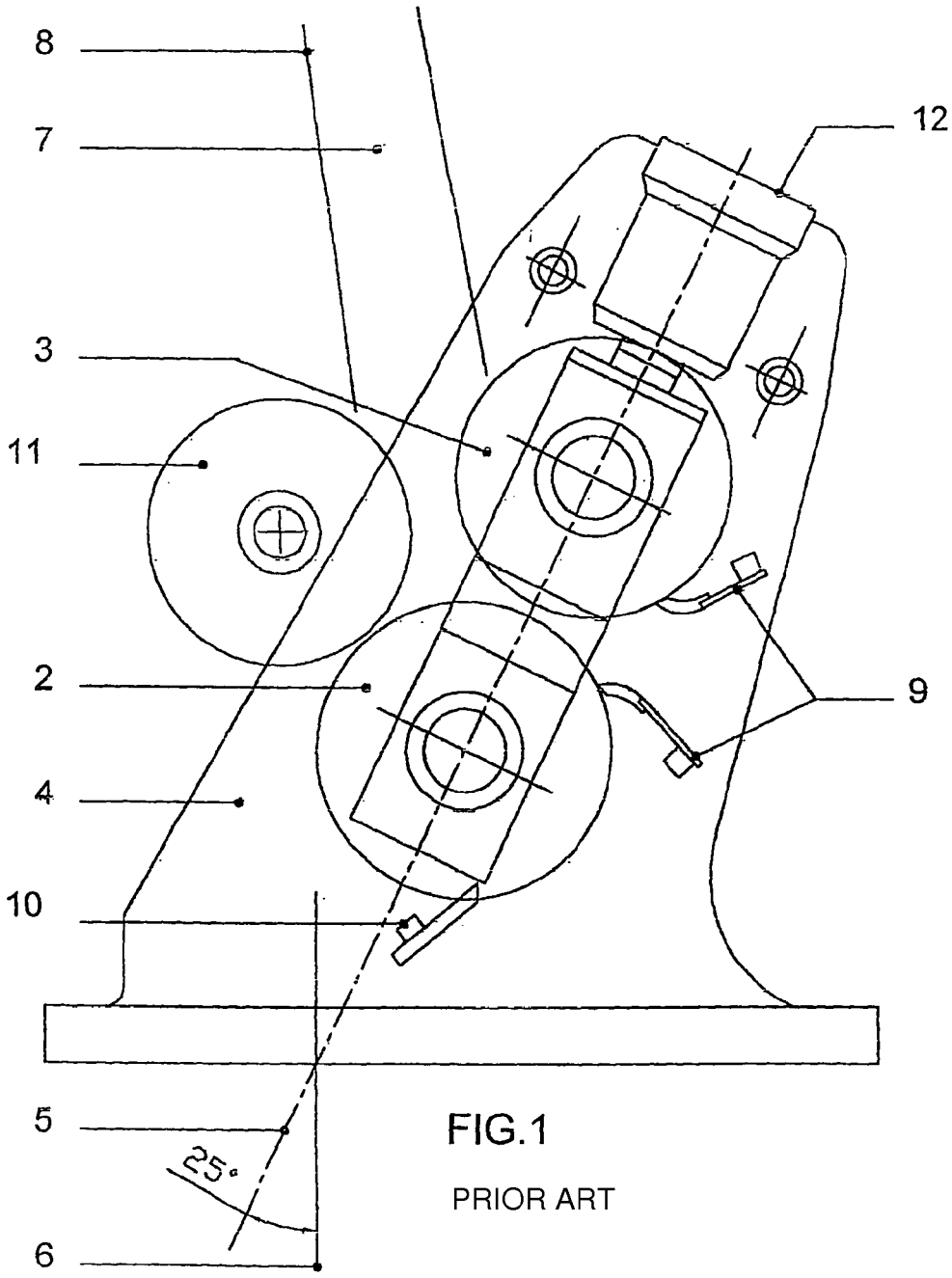
FIG.1 PRIOR ART
FIG. 1 shows in schematic side view a conventional two roll sugar cane crushing mill module.

Referring to FIG. 1, a conventional two roll sugarcane crushing mill module (1) mainly comprises of a bottom roll (2) and a top roll (3) mounted in a pair of head stocks/closed frames (4) provided at two ends, with the help of bearings and wear plates. The central axis (5) of the bottom and top rolls (2,3) is kept inclined, at about 25 degrees, to the vertical axis (6) to take feed of prepared cane/bagasse (7) from a Donnelly chute (8). The bottom and top rolls are cast iron grooved rolls generally of almost equal size/diameter and provided with scrapers (9) and scraper cum knife (10) in a known manner.

Sometimes a grooved feeder roller (11) working as under feeder roller is also provided to compress the cane bagasse (7) before feeding to main crushing rolls. The feeder roller (11) is mounted on the frame (4) in a fixed manner. Sometimes two or more feeder rollers (not shown) are also provided to compact the cane/bagasse mat and stationary closed pressure chute (now shown) is provided in between the feeder roller and the main crushing rolls (2,3). The top roll (3) is directly loaded with the help of a hydraulic loading means (12) to maintain a pressure on the cane/bagasse mate passing between the top and bottom rolls. The disadvantages, further to as described hereinbefore, of the conventional two roll sugarcane crushing mill are, top roll bearings slide against the wear plates in the head stocks (4). There is horizontal reaction on sides, due to the driving TORQUE.

There is higher bearing pressure which makes, the sides of the top bearings and wear plates, to wear fast and uneven at top and bottom surfaces of sides of top bearings, this will create misalignment which will not allow free floating of the top roller. Once the misalignment is developed it is difficult to rectify it specifically during the same crushing season. Hydraulic load is to be given equal to cane/bagasse; reaction and whole hydraulic system is to be designed for such high pressure, due to direct loading. There is side reaction on the ram of the hydraulic system/loading means according to the driving force. Lubrication is required between side plates of top bearings and wears plates. Cast-iron grooved under feeder roller (11) needs precise setting and any variation in crushing poses problem of slippage and Donnelly chute gets overflowed resulting into long stoppage or down time of mill.

Figure 2:
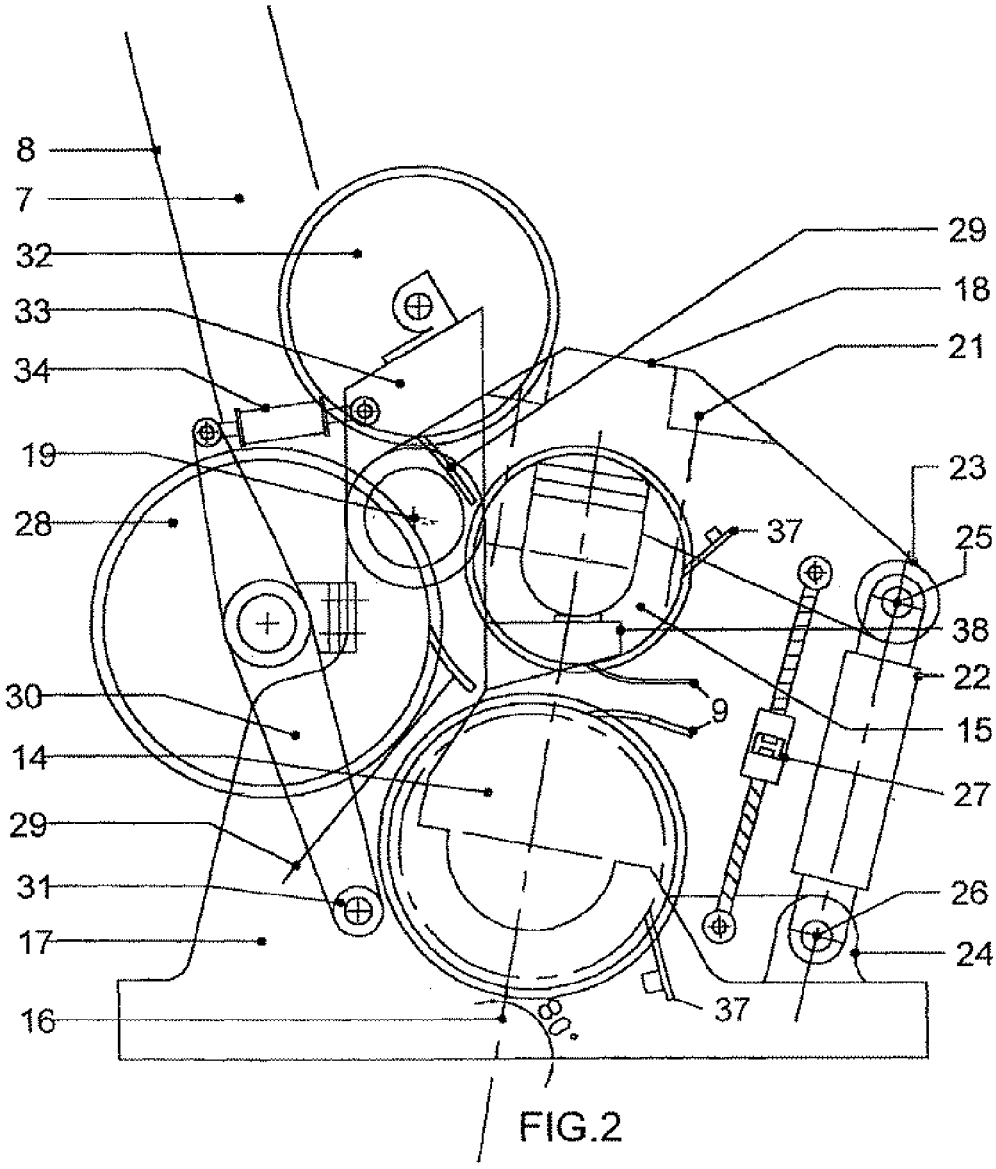
FIG. 2 shows in schematic side view an improved two roll sugarcane crushing mill module, according to an embodiment of this invention.
Figure 3:
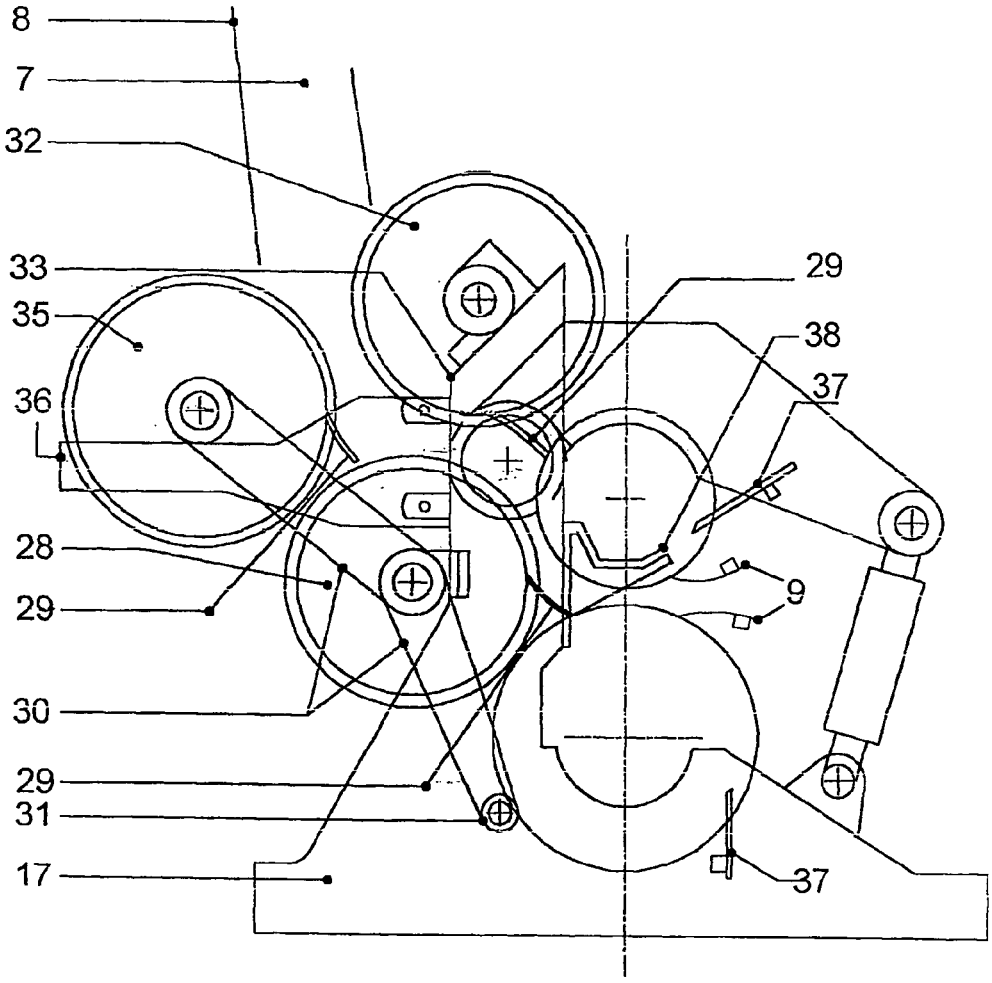
FIG. 3 shows in schematic side view an improved two roll sugarcane crushing mill module, according to another embodiment of this invention.

Referring to FIGS. 2 and 3, the improved two roll sugar cane crushing mill, according to this invention comprises a plurality of improved two roll mill modules (13) provided in tandem. Each of the improved two roll mill module (13) comprise a bottom roll (14) and a top roll (15). The bottom roll (14) is preferably of larger diameter than the top roll (15) diameter and the central axis (16) of the rolls (14,15) is kept substantially vertical. The bottom roll (14) is rotatingly mounted in a pair of main frames/headstocks (17) provided at the two ends which is open at on side. The top roll (15) is rotatingly mounted in top beam/lever arm (18) which is pivotally attached at the upper end of the main frame/head stock (17), at feed side with the help of pin (19). The top roll seats which are preferably spherical, semi-spherical or cylindrical are flexibly connected to the top beam (18) preferably with the help of flexible bolts or like means (21).

A hydraulic loading means/system (22) is flexibly connected in between the free end (23) of the top beam (18) and the base (24) of the main frame/head stock (17) with the help of pins (25,26). In case of failure of the hydraulic loading system (22), to keep the mill module in operating position, till the hydraulic system is repaired and replaced in position a mechanical means, such as tie rod/stud and nut (27) may also be additionally provided adjacent to the hydraulic loading means (22). At least one feeder roller (28) having a scraper-cum-deflector (29) with juice drainage means adjustably mounted therewith is provided in close proximity of the crushing rolls (14,15). The roller (28) is preferably mounted on an auxiliary frame (30) which is rigidly or pivotally attached on the main frame/headstock (17) with the help of pivot pin (31). As an alternative the auxiliary frame (30) may be rigidly or pivotally mounted on the separate base (not shown), adjacent to main frame (17). When two or more feeder rollers are provided for more compacting the cane/bagasse mat, the second feeder roller (32) as shown in FIG. 2 is mounted on the top of the main frame (17) directly or with the help of a bracket (33) attached or made integrally with the side main frame (17). The auxiliary frame (30) and the bracket (33) may be inter connected with the help of hydraulic means (34) for flexibly adjusting the gap between the feeder rollers (28,32) and or between the feeder rollers (28) and main crushing rolls (14,15) and thereby adjusting the loading on the cane/bagasse. (A known mechanical means may be provided in between the auxiliary frame and main frame from maintaining the desired gap settled in between the rollers.).

As shown in FIG. 3, when there are three feeder rollers (28,32 and 35), the feeder roller (35) may be mounted on a protrusion/bracket (36) attached in a known manner to the main frame/headstocks (17) or on the auxiliary frame (30). The feeder rollers (32) and (35) are mounted slidably for adjusting the gap in between the feeder rollers. A support or wedge (38) fixed to the main frame (17) may also be provided to support the top roll (15) at minimum gap level in between the crushing rolls. Mostly the under feeder rollers such as (28 and 35) are provided with scraper-cum-deflector (29) while the over feeder roller such as (32) may be or may not be provided with a scraper-cum-deflector (29). The feeder rollers may be grooved rollers or toothed rollers or grooved roller with perforation/messacheart grooves or toothed perforated rollers or any combination of any such rollers. The bottom and top crushing rolls (14, 15) may be grooved perforated rollers (lotus) and or may be provided with messacheart grooves and knives (37) in a known manner and may also be provided with scrapers (9).

A plurality of improved mill modules (13) is provided in tandem. The last mill module may be replaced by an existing type three roll mill module in order to reduce the moisture contents of the bagasse being discharged at the final stage of crushing as a two roll mill module works on low pressure while three roll mill module works on high pressure thereby SQUEEZING out more water from the bagasse.

It will be clear from the above description with reference to figures, that hydraulic system of lower pressure will give more effective pressure (due to leverage) on the top roll (15). Top roll along with top beam can be swung upwards and hung up by known means and by just disconnecting the hydraulic system (22) from the end (23) by removing the pin (25), top and bottom roller can be taken out completely. The feeder rollers are mounted in close proximity of main crushing rolls hence stationary closed pressure chute is not required due to scraper-cum-deflector (29) provided with feeder roller (28) cane/bagasse mat once compressed will not expand and hence GRIPPING angle of the crushing rolls will be smaller.

A support or wedge (38) fixed to the main frame (17) may also be provided to support the top roll (15) at a minimum gap level in between the crushing rolls.

Advantages of the Invention (a) There is no relative motion between top beam and top bearing, therefore no sliding and hence all the drawbacks due to sliding of bearing are eliminated.

(b) No lubrication required for bearing movement. It consumes less power due to elimination of sliding friction.

(c) There is rotational friction in the pivot pins of the top beam, instead of sliding friction and rotational friction is always better/less than sliding friction. Further the pivot pins for swings are provided with anti-friction bearings bringing down the frictional power almost negligible.

(d) There in provision of spherical seat arrangement between top beam and top roll bearings, which take misalignment due to uneven lifting of top roll. It also maintains the even bearing pressure for all positions of the floating top roll and improves the bearing life, requires less lubricants, and damages to the bearings surfaces.

(e) Hydraulic operating pressure given to cylinder according to this invention is much less than that required in conventional mills for the same load. Hence the hydraulic system is to be designed for less load hence is very economical and consumes less power.

(f) No oblique reactions on piston rod-as swinging type plain spherical bearings are provided at both the end of hydraulic cylinder, holding arrangement, hence hydraulic seal/system failure chances are considerably less, reducing the maintenance and mill down time.

(g) Minimum gap between two crushing rolls is maintained at the top beam position hence setting is very easy, lifts freely and sets itself in case the drive is given through bottom roll.

(h) Top roll bearing and bottom rolls bearing can be taken out with out taking out rolls.

(i) Top roll and bottom roll can be taken out without dismantling the top beam from its pivot and the rolls are slided out through the open side of the main frame.

(j) Easy and quick maintenance hence less down time and increased productivity of the mill.

(k) Substantial vertical axial plane mounting of the top and bottom rolls help juice drainage by gravity over the bottom roll.

(l) No precise setting is required for toothed feeder roller. It can accommodate any variation in cane/bagasse rate without any misalignment and hence once it is set, no resetting is required during the crushing season.

(m) One additional compression is achieved in a five roller mill (two main crushing rolls and three feeder rollers) in comparison with conventional mills.

(n) Same performance with less number of rollers thus, considerably low power consumption and as the rollers are less, maintenance cost is also less. Further effective and efficient pre-extraction of juice and its drainage is achieved which reduces liquid pressure in compression zone and thus reduces re-absorption factor and improves over all juice extraction.

(o) Pivot provided at the top roll supporting arm towards feed side facilitates easy and proper fitting and working of feeder roller.

(p) Specially suited for expansion to higher crushing rate with the addition of one or two mill modules according to this invention provided in the existing mill tandem.

The above description with reference to drawings is given just to understand the invention rather than to limit its scope.

I claim:

1. A sugar cane crushing mill comprising:

a pair of crushing rolls having only a single bottom roll, said single bottom roll having a bottom axis, and a single top roll, said single top roll having a top axis;

a pair of main frames mounted respectively to opposite ends of said bottom roll, said bottom roll being rotatably mounted to said pair of main frames, said pair of main frames having a support connected thereto, said support being cooperative with said top roll so as to support said top roll at a minimum gap position with respect to said bottom roll;

a pair of top beams mounted respectively at opposite ends of said top roll, said top roll being rotatingly mounted to said pair of top beams, one end of each of said pair of top beams being pivotally attached adjacent an upper end of said pair of main frames, said bottom axis and said top axis being substantially vertically aligned and defining a feed side and a discharge side of said pair of crushing rollers, wherein said pair of top beams has a mechanical holding means connected at a base of said pair of main frames and the ends of each of said pair of top beams, said mechanical holding means pivotally mounting said top roll above said bottom roll;

a hydraulic loading means pivotally attached between an end of said pair of top beams opposite said feed side and a base of said pair of main frames;

a feeder roller having a scraper-cum-deflector positioned adjacent to the top and bottom rolls, said feeder roller having a juice drainage means cooperative therewith for draining juice from the sugar cane passing therealong, said feeder roller being positioned independent of said hydraulic loading means; and an auxiliary frame mounted to the feeder roller, said auxiliary frame being mounted to said pair of main frames, said feeder roller being positioned on said feed side of said pair of crushing rolls and above said bottom axis, said feeder roller being positioned on said auxiliary frame independent from said top roll mounted on said pair of top beams, said bottom roll having a diameter that is substantially larger than a diameter of said top roll, each of said pair of top beams having a free end adjacent to said hydraulic loading means.

2. The crushing mill of claim 1, each of said top roll and said bottom roll having grooves formed on a periphery thereof.

3. The crushing mill of claim 1, at least one of said top roll and said bottom roll having perforations formed thereon.

4. The crushing mill of claim 1, at least one of said top roll and said bottom roll having knives formed thereon.

5. The crushing mill of claim 1, wherein said feeder roller is comprised of a pair of feeder rollers, one of said pair of feeder rollers being mounted at opposite ends thereof on said pair of main frames.

6. The crushing mill of claim 5, wherein said auxiliary frame and said pair of main frames flexibly interconnect at upper ends thereof, said pair of feeder rollers and said top and bottom rolls having a gap therebetween adjusted by said hydraulic loading means.

7. The crushing mill of claim 5, said pair of feeder rollers comprising an upper feeder roller and a lower feeder roller, said upper feeder roller having a scraper-cum-deflector thereon.

8. The crushing mill of claim 1, said feeder roller being a grooved roller.

9. The crushing mill of claim 1, said feeder roller being a toothed roller.

10. The crushing mill of claim 1, said feeder roller being perforated.

* * * * *